United States Patent [19]

Weisenberger

[11] Patent Number: 4,686,928

[45] Date of Patent: Aug. 18, 1987

[54] TOROIDAL WHISTLE

[76] Inventor: Richard J. Weisenberger, Rte. 12, Box 121, Lot 18, Paducah, Ky. 42001

[21] Appl. No.: 839,913

[22] Filed: Mar. 14, 1986

[51] Int. Cl.[4] ..... B06B 1/18

[52] U.S. Cl. ..... 116/137 R; 116/DIG. 19

[58] Field of Search ..... 116/137 R, 137 A, DIG. 19

[56] References Cited

U.S. PATENT DOCUMENTS

| | | | |
|---|---|---|---|
| 44,006 | 8/1864 | Lincoln | 116/137 R |
| 1,288,798 | 12/1918 | Aull | 116/137 R |
| 1,449,211 | 3/1923 | Baker | 116/137 R |
| 1,518,107 | 12/1924 | Rafferty | 116/137 R |
| 1,530,899 | 3/1925 | Limon | 116/137 R |
| 2,092,405 | 9/1937 | Neveu | 116/137 R |
| 2,678,625 | 5/1954 | Hall et al. | 116/137 R |
| 4,429,656 | 2/1984 | Weisenberger | 116/137 R |

FOREIGN PATENT DOCUMENTS

| | | | |
|---|---|---|---|
| 84935 | 6/1895 | Fed. Rep. of Germany | 116/137 R |

*Primary Examiner*—Charles Frankfort
*Assistant Examiner*—Patrick R. Scanlon
*Attorney, Agent, or Firm*—Frost & Jacobs

[57] ABSTRACT

A single-tone inverted toroidal whistle for producing a uni-directional output of about 135 decibels at 100 feet on axis at a frequency of about 420 hertz. A hollow cylinder having a closed base end is combined with a toroidal body to provide an annular sound chamber the working length of which determines the wavelength of sound generated by passage of air or steam under pressure through an annular slit formed in the interior of the cylinder and impinging against a spaced tapered lip on the inner cylindrical wall of the toroidal body.

14 Claims, 5 Drawing Figures

SPL CONTOUR OF 220 Hz DYNAWHISTLE (EXTRAPOLATED)

SPL CONTOUR OF 440Hz DYNAWHISTLE (EXTRAPOLATED)

SPL CONTOUR OF 880 Hz DYNAWHISTLE (EXTRAPOLATED)

TOROIDAL WHISTLE

BACKGROUND OF THE INVENTION

This invention relates to a toroidal whistle which when horn loaded provides uni-directional sound production with relatively high efficiency and which can be operated either by air or steam of relatively low pressure (e.g. 15 psig). Although not so limited, the whistle of the invention has utility on board ships, as a civil defense warning device, for acoustic stress testing of components for the aerospace industry and as coded signaling and/or warning devices.

At a frequency of 440 hertz, the whistle of the present invention produces a sound output of 135 decibels at 100 feet on axis. At a frequency of 220 hertz a whistle in accordance with the invention would be capable of producing a sound level up to 55 decibels at a distance up to 12 miles.

U.S. Pat. No. 4,429,656, issued Feb. 7, 1984 to the present applicant, discloses a toroidal closed chamber whistle capable of producing levels up to 125 decibels at 100 feet at a frequency of 440 hertz. The whistle of this patent provides a torus positioned on a hollow cylinder, a circular cover affixed to the top of the torus, an annular tapered lip descending perpendicularly from the cover in alignment with an air passage from the cylinder and surrounding the torus, the torus, lip and cover forming a toroidal chamber in which a sound wave is generated. The tapered lip and aligned air passage are thus arranged at the outer diameter of the toroidal chamber. The length of the toroidal sound chamber is three times the width thereof, and the outer diameter of the chamber is about 0.625 times the fundamental wave length of the generated sound. The whistle of this patent produces a bidirectional sound.

U.S. Pat. Nos. 48,921, issued July 25, 1865 to A. Fitts and 596,257, issued Dec. 28, 1897 to L. Bartlett, disclose early steam whistles typical of the prior art which required steam pressure of at least about 40 to 60 psig, and which provided cylindrical whistle bells each having a depending lip around the outer edge aligned with an annular slit through which steam passes under pressure, thereby generating sound.

German Pat. Nos. 84,935, published January 1896 and 523,008, published April 1931, disclose somewhat similar arrangements wherein a circular depending tapered lip surrounds a sound chamber, with the lip being aligned with a narrow annular slit through which steam under pressure passes. The lower portion of the whistle disclosed in German Pat. No. 94,935 has a cross-section which resembles that of a vortex whistle, a type which has less output than that of an ordinary cylindrical whistle.

Whistles produce maximum sound output when the radiating mouth area (between the tapered lip and narrow annular slit) is equal to the cross-sectional area of the chamber. Increasing the radiating mouth area beyond that of the chamber only increases the required operating pressure but not the sound output. A decrease in mouth area results in a loss of output, e.g. a mouth area half that of the chamber cross-section would result in an estimated loss of about 12 decibels. With the arrangement shown in the drawing of German Pat. No. 84,935, high output would thus be impossible.

Single chamber whistles of the type disclosed in the above early patents are limited in sound output by the capacity of the single chamber, are relatively inefficient (about 1% to 3%) and require high pressure steam or air. The output of such a whistle would be about 110 decibels at 100 feet, if a chamber length to chamber diameter ratio of 3:1 is used. An increase in diameter of the cylindrical chamber relative to its length does not significantly increase the output but would require more compressed steam or air. In an effort to improve output, two of the above-mentioned patents disclose the provision of two or more chambers combined into a single system. However, such a system cannot produce a directional output due to the small radiating area, and since the individual whistle chambers cannot be phase-locked to a single pitch, attempts to blow several whistles of the same pitch may actually result in reduced output. Whistles of different pitches would increase output but would result in a multi-pitch sound.

The whistle of the present invention is distinguishable from that of applicant's above-mentioned U.S. Pat. No. 4,429,656 in providing a substantially toroidal body secured to a hollow cylinder with a tapered lip on the inner wall of the toroidal chamber rather than on the outer wall. This has made possible an unexpected increase in efficiency of up to 25% by permitting the use of less air or steam under pressure to obtain equal power output. When using the same amount of air, a correspondingly greater power output is produced, and horn loading concentrates this output into a uni-directional sound beam of 60° dispersion with up to 10 decibels greater output on axis. It will of course be understood that the whistle of the present invention can be adapted to full 360° coverage if desired, by rotating the unit.

As indicated above, the whistle of U.S. Pat. No. 4,429,656 is bidirectional. The whistle of the present invention is substantially omni-directional without a horn, but is unidirectional when horn-loaded.

An increase in efficiency is obtained in the whistle of the invention due to the fact that blowing the toroidal chamber from the inner diameter thereof fully excites a radiating area (the area between the inner and outer diameters of a toroid) equal to that of U.S. Pat. No. 4,429,656 but uses only about 75% of the driving area (the area within the inner diameter of a torus) to do so, at the same steam or air pressure. For example a 20 inch diameter whistle of the present invention would have an annular slit of about 15 inches in diameter, whereas a 20 inch diameter whistle of U.S. Pat. No. 4,429,656 would have an annular slit of 20 inches in diameter since it is blown from the outer diameter thererof. In this connection it will of course be recognized that a conventional cylindrical whistle has only an outside edge and hence can be blown only from the outer diameter.

SUMMARY OF THE INVENTION

The present invention provides a single-tone inverted toroidal whistle for producing a uni-directional output comprising:

(a) a hollow cylinder having a closed base end, a cylindrical side wall and an open top end;

(b) the base end of said cylinder having a central circular aperture providing an inlet for passage of air or steam under pressure into the hollow interior of said cylinder;

(c) a circular plate positioned coaxially within said hollow cylinder parallel to said base end and spaced therefrom a distance equal to about one-quarter the inner diameter of said inlet, said plate having a substantially right-angled outer edge and being dimensioned to provide an annular opening between said edge and said cylinder;

(d) an annular flange projecting inwardly from said side wall of said cylinder toward said edge of said circular plate and occupying said annular opening, said flange having a tapered inner edge spaced about one-sixteenth inch from said outer edge of said plate, whereby to form an annular slit for passage of air or steam therethrough;

(e) a substantially toroidal body secured to said cylinder at said top end thereof, said toroidal body comprising an annular cover secured to said top end of said cylinder and projecting inwardly substantially normal to said side wall thereof, and an inner cylindrical wall depending from said annular cover and defining an interior cavity, said inner wall being coaxial with said side wall of said cylinder and aligned with said annular slit and terminating in a tapered lip projecting toward and spaced from said annular slit;

(f) a phasing plug of parabolic axial cross-section secured to said plate and projecting into said interior cavity of said torus in coaxial relation therewith; and (g) an exponential horn attached to said toroidal body at the end thereof remote from the base end of said cylinder;

(h) said toroidal body and said side wall of said cylinder defining an annular sound chamber the working length of which is the distance between said annular flange and said annular cover, said working length determining the wavelength of sound generated by passage of air or steam under pressure through said annular slit and impinging against said tapered lip.

BRIEF DESCRIPTION OF THE DRAWINGS

Reference is made to the accompanying drawings wherein.

DETAILED DESCRIPTION OF THE INVENTION

A true whistle has no moving parts and hence is advantageous from the standpoint of maintainance and durability in comparison to other devices for generating sound such as a siren, air horn or diaphone, all of which require moving parts. In addition to this advantage, the whistle of the present invention is extremely powerful and efficient and can be operated either by air or steam at a pressure of about 10 to 20 psig.

Toroidal whistles produce high sound output because they operate as if they were a large number of conventional cylindrical whistles of the same pitch blowing together in phase, rather than as a single large cylinder of the same diameter as that of the toroidal whistle. A single cylinder whistle of large diameter would be very inefficient, would require high pressure and volume of steam or air, and would produce only a relatively small fraction of the sound output of a toroidal whistle of the same diameter.

Sirens use a rotary chopper which modulates air flow to a horn. The far field performance of most sirens is limited by high harmonic content in the output which contributes to the high decibel reading thereof in the near field, but due to atmospheric absorption of high frequencies contributes nothing to far field propagation performance. The high harmonic content also presents a hazard to hearing.

Modulated air loudspeakers operate as a voice coil controlled valve to modulate air flow to a horn. These are of low efficiency, generally about 4 to 5 percent.

High intensity acoustical noise generators are complex and utilize moving parts, including poppet valves which modulate a high pressure air stream to a horn.

So-called Tyfon horns use a vibrating diaphragm to modulate the air stream to the horn. The frequency of such devices is determined by the length of the horn. Although such horns are quite powerful, the efficiency is on the order of 5% to 10%, and high pressure air is required.

A diaphone uses a vibrating slotted piston to modulate air flow to a horn and is also of low efficiency.

The frequency of the toroidal whistle of the present invention is determined by the working length of the toroidal chamber. A wide range of frequencies is possible, although frequencies between 200 and 1000 hertz are most effective as a signal. The frequency can be determined by the following formula when the mouth area equals the cross-sectional area of the toroidal chamber:

$$\lambda = \frac{\text{working length in feet} \times 4}{K}$$

where $\lambda$ = wavelength in feet working length = distance from annular slit to top of sound chamber K = constant for toroidal whistle = 0.95.

The wavelength ($\lambda$) is used to calculate the frequency by the following equations:

$$f = \frac{1100}{\lambda}$$

$$f = \frac{1300}{\lambda}$$

where f = frequency in hertz

1100 = speed of sound in air (feet/sec.)

1300 = speed of sound in steam (feet/sec.).

Figure 2:
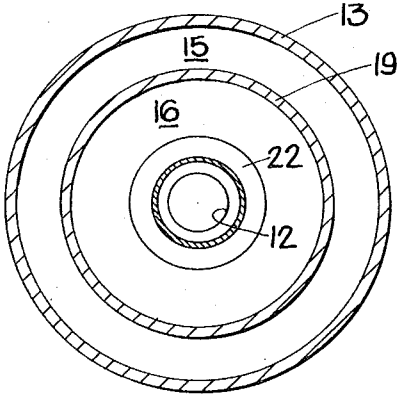
FIG. 2 is a sectional view along the line II—II of FIG. 1.
Figure 1:
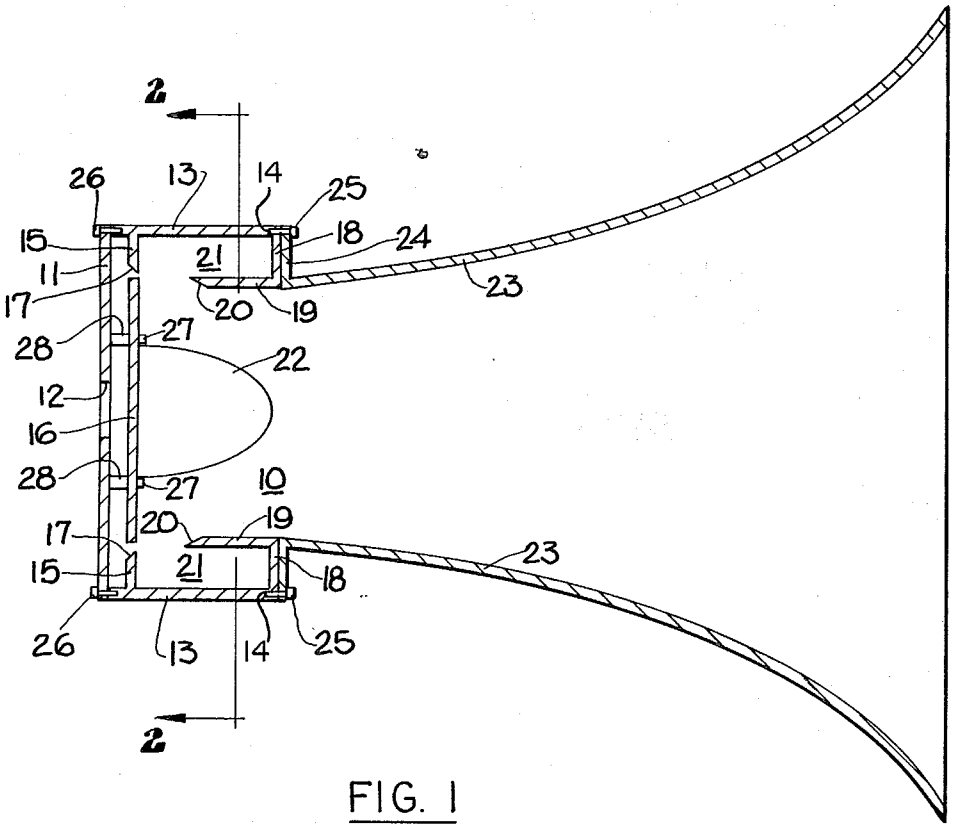
FIG. 1 is a vertical sectional view of a toroidal whistle embodying the invention.

Referring to FIGS. 1 and 2, a hollow cylinder is indicated generally at 10. Cylinder 10 comprises a closed base end 11, except for a central aperture 12 for passage of air or steam from a supply pipe and compressor (not shown). Cylinder 10 further comprises a cylindrical side wall 13 and an open top 14.

An annular flange 15 is provided which projects inwardly from side wall 13, the flange terminating in a tapered inner edge, the angle of taper preferably being about 30° outwardly toward the side wall. A circular plate 16 is positioned coaxially within the cylinder parallel to base end 11 and spaced therefrom a distance equal to about one-quarter the inner diameter of the inlet provided by central aperture 12 and supply pipe connected thereto. Plate 16 is aligned with annular flange 15 and has a substantially right-angled outer edge terminating about one-sixteenth inch from the tapered inner edge of annular flange 15, so as to provide an annular slit indicated at 17 for passage of air or steam under pressure from inlet aperture 12.

It is essential that the spacing between base end 11 and annular flange 15 along with circular plate 16 be about one-quarter the inner diameter of the inlet, and that the annular slit 17 have a width of about one-sixteenth inch, in order that the inlet area exceed the area of the annular slit. Regardless of the size of the whistle of the invention, the annular slit will have a width of about one-sixteenth inch. An annular slit having a width greater than about one-sixteenth inch will not direct the gas stream properly and will merely waste air or steam with no increase in output. On the other hand, an annular slit substantially less than about one-sixteenth inch will greatly increase the required operating pressure and lower the efficiency. Since a whistle of a given ratio of chamber length to diameter depends upon a given flow rate (regardless of pressure) reducing the width of the annular slit to, e.g., one-thirty-second inch would require quadrupling the operating pressure in order to obtain the same flow rate, and efficiency would be reduced to one-quarter.

It is important that the inlet area (determined by the inner diameter of central aperture 12 and the supply pipe connected thereto) be varied for whistles of varying diameters so that the inlet area is equal to or greater than the area of the annular slit. The inner diameter of the inlet should vary by the square root of the diameter of the base end 11. Accordingly, while a 20 inch diameter whistle should have a three inch inlet diameter, a 10 inch whistle should have a minimum inlet diameter of 2.12 inches, and a 40 inch diameter whistle should have a minimum inlet diameter of 4.24 inches.

A substantially toroidal body is provided secured to cylinder 10 at the top end 14 thereof. The toroidal body comprises an annular cover 18 projecting inwardly substantially normal to side wall 13, and an inner cylindrical wall 19 depending from annular cover 18 and defining an interior cavity. Inner wall 19 is coaxial with side wall 13 of the cylinder and is aligned with the annular slit 17. Inner wall 19 terminates in a tapered lip 20 which projects toward and is spaced from annular slit 17. Preferably the angle of taper is about 15° and is cut to face inwardly.

The toroidal body comprised of annular cover 18 and inner cylindrical wall 19, together with side wall 13 of cylinder 10, defines an annular sound chamber indicated at 21. The working length of sound chamber 21 is the distance between annular flange 15 and annular cover 18 and is preferably three times the width of the annular sound chamber. The spacing of tapered lip 20 from the annular slit 17 (i.e. the radiating mouth area) is preferably less than one-half the working length of sound chamber 21 and in an exemplary embodiment should be about 0.4 times the length of the sound chamber. Optimally, the radiating mouth area should be equal to the cross-sectional area of chamber 21 for maximum output.

A phasing plug having a parabolic axial cross-section is indicated at 22 and is secured to circular plate 16 in such manner as to project into the interior cavity of the toroidal body in coaxial relation therewith. The diameter of phasing plug 22 should not be so large as to restrict the radiating mouth area but large enough to prevent phase cancellation in the throat area. Preferably it is about one-half the diameter of inner cylinder 19. Phasing plug 22 is provided in order to prevent interference due to phase cancellation in the relatively large throat of the whistle.

In order to obtain controlled polar dispersion and maximum effective radiated power, an exponential horn is provided as indicated at 23. Horn 23 may be secured to annular cover 18 by means of a circular flange 24 at the inner end of horn 23. Preferably the diameter of the horn at the flange 24 is the same as the diameter of the inner cylindrical wall 19 of the toroidal body. The manner of attachment of exponential horn 23 is not critical, and may comprise a plurality of equally spaced threaded bores through flange 24 into side wall 13 in which bolts 25 may be threadedly engaged. Optimum performance is obtained with an outermost diameter of horn 23 equal to about 1.5 times the wavelength of the sound generated by the sound chamber 21. Preferably the resonant frequency of horn 23 is substantially less than that of the sound chamber 21 in order to prevent horn resonance from occurring at or near the operating frequency of the whistle, a condition which could interfere with proper operation.

In an exemplary embodiment which produces a sound frequency of about 418 hertz when operated with air at 15 psig, an output of 135 decibels at 100 feet on axis is obtained by the whistle of the invention. The hollow cylinder is fabricated from one-half inch stainless steel plate, with the diameter of cylinder 10 being 20 inches, the inner diameter of central aperture 12 and its supply pipe being 3 inches, the space between base end 11 and circular plate 16 being 0.75 inch, the length of sound chamber 21 being 7.5 inches and the width 2.5 inches. As indicated previously, the width of annular slit 17 is about one-sixteenth inch. The spacing of tapered lip 20 friom annular slit 17 is about 3 inches, and the diameter of central phasing plug 22 is about 7 inches, while the diameter of inner cylindrical wall 19 is 14 inches.

The base end 11 of the cylinder 10 may conveniently be secured to the side wall 13 thereof by a plurality of threaded holes and bolts 26. The parabolic phasing plug 22 may similarly be secured to circular plate 16 by a plurality of bolts indicated at 27. The spacing of circular plate 16 from the base end 11 may be controlled by sleeves 28 through which bolts 27 pass into threaded holes in base end 11.

The exponential horn 23 may be fabricated from aluminum of one-half inch thickness and should have an outermost diameter of about 45 inches, i.e. about 1.5 times the wavelength.

Referring again to FIG. 2, the radiating area is defined by the annular cross-sectional area between side wall 13 and inner wall 19, while the driving area is defined by the cross-sectional area inside cylindrical inner wall 19. With the design of this invention the output and radiating area are equivalent to an imaginary circle of 28 whistles of conventional cylindrical type of the same frequency, each having a diameter equal to the radial distance between side wall 13 and inner wall 19, each whistle having a chamber length to chamber diameter ratio of 3:1, and all whistles having the same pitch and blowing together in phase. A cylindrical single chamber whistle produces a maximum output of about 110 decibels at 100 feet (440 hertz frequency), and about 3 decibels are added each time the number of chambers is doubled, with a chamber length to diameter ratio of 3:1. Accordingly, the present invention achieves an output equivalent to 28 conventional cylindrical whistles but has a driving area about 25% less and operates at substantially lower pressure.

Whistles in accordance with the invention can readily be designed for any desired predetermined frequency by multiplying all dimensions by a given number, except inlet aperture 12, annular slit 17 and the spacing between base end 11 and annular flange 15 and circular plate 16. Thus, doubling the dimensions set forth above for a frequency of 418 hertz would result in a whistle having one-half the frequency, i.e. 209 hertz. The pressure requirements for air or steam remain the same regardless of the size of the whistle.

Figure 3:
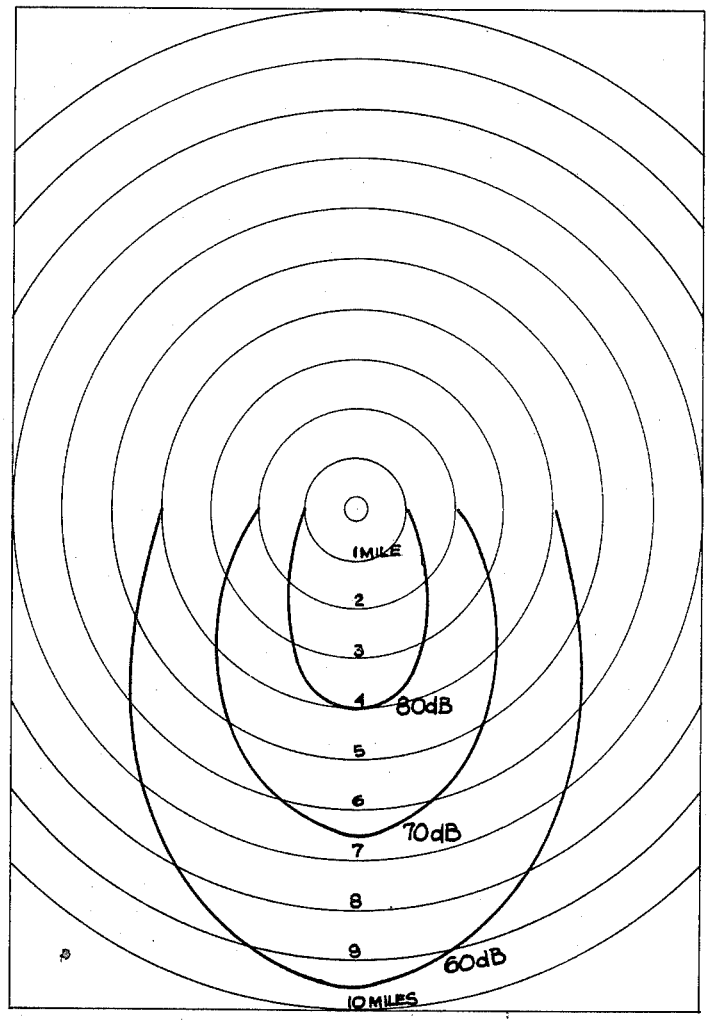
FIG. 3 is an extrapolated sound pressure level contour graph of a whistle of the invention at a frequency of 220 hertz.
Figure 4:
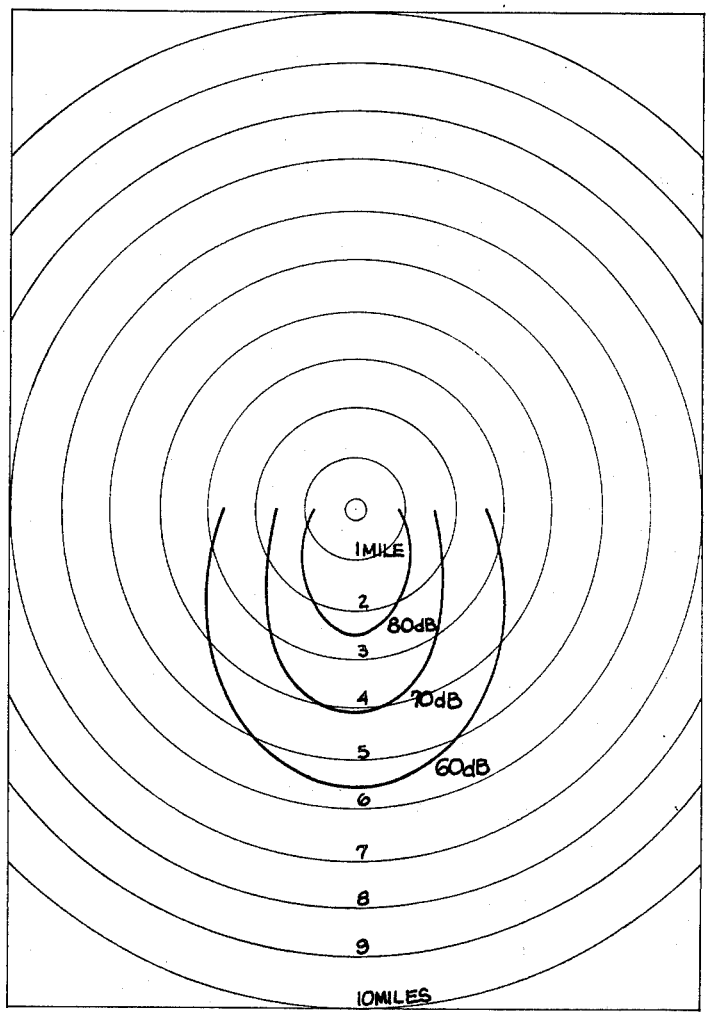
FIG. 4 is an extrapolated sound pressure level contour graph of a whistle of the invention at a frequency of 440 hertz.
Figure 5:
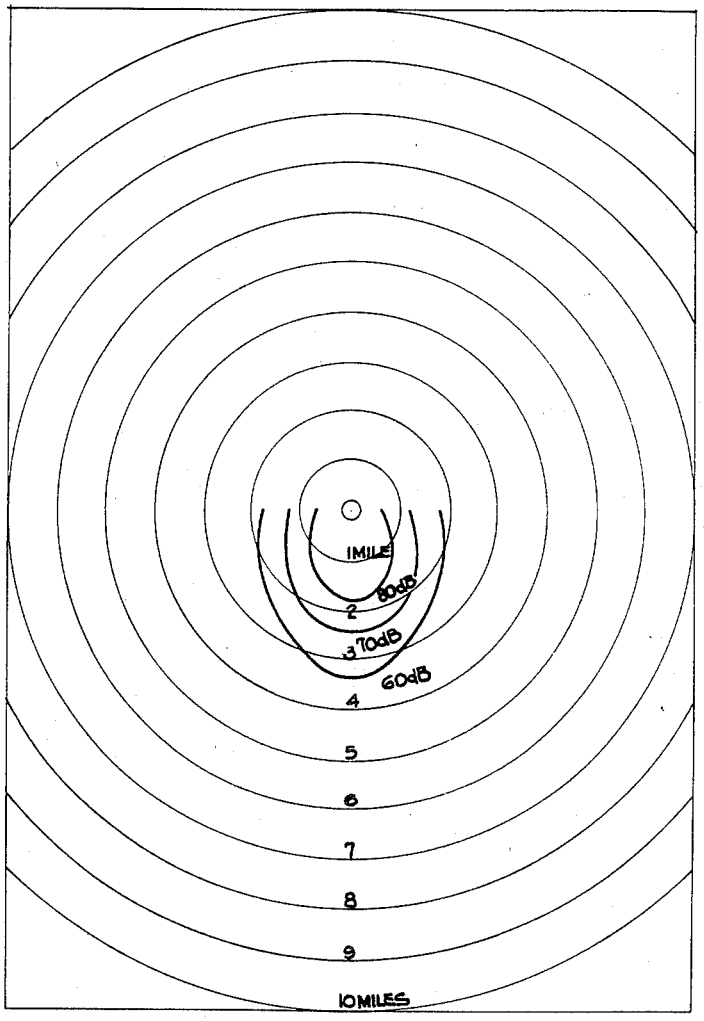
FIG. 5 is an extrapolated sound pressure level contour graph of a whistle of the invention at a frequency of 880 hertz.

Referring to FIGS. 3, 4 and 5, sound pressure level contour values are extrapolated on the basis of propagation and polar dispersion data. It is apparent that maximum carrying power of up to 10 miles is obtained at a frequency of 220 hertz, as shown in FIG. 3. The lower carrying power of higher frequencies such as 440 and 880 hertz is due to atmospheric absorption of the higher frequencies. On the other hand, a low frequency whistle is less efficient, but the greater carrying power more than compensates for this loss.

For uses where full 360° sound signaling is desired, it is within the scope of the invention to provide means for rotating a whistle of the invention in a horizontal plane.

FIGS. 3-5 assume unobstructed level terrain, and such graphs are useful as a guide in planning installation sites. Mounting height should be sufficient so as not to limit propagation due to uneven terrain or obstructions, as well as to avoid a possible safety hazard to persons living near the installation site. Minimum mounting heights above ground level for units of high output are established by the Federal Emergency Management Agency in its manual "Outdoor Warning Systems Guide (CPG 1-17)".

As indicated above, the whistle of the present invention is applicable to a wide variety of applications with marked advantages over conventional devices for generating sound. Unlike sirens, whistles have almost instantaneous attack and decay characteristics and hence are ideally suited for coded signaling and warning applications. If desired, a vibrato effect could be produced by installing a tremulant in the compressed air or steam supply line, this being a device to vary the pressure at a slow, steady rate.

Since whistles in accordance with the invention produce a fixed frequency, a set of whistles, each of different frequency, could be provided to produce a chord, to sound chimes, or to make a calliope-like musical instrument.

Other modifications within the scope of the invention will occur to those skilled in the art, and no limitations are to be inferred except as set forth in the appended claims.

I claim:

1. A single-tone inverted toroidal whistle for producing a uni-directional output comprising:

(a) a hollow cylinder having a closed base end, a cylindrical side wall and an open top end;

(b) the base end of said cylinder having a central circular aperture providing an inlet for passage of air or steam under pressure into the hollow interior of said cylinder;

(c) a circular plate positioned coaxially within said hollow cylinder parallel to said base end and spaced therefrom a distance equal to about one-quarter the inner diameter of said inlet, said plate having a substantially right-angled outer edge and being dimensioned to provide an annular opening between said edge and said cylinder;

(d) an annular flange projecting inwardly from said side wall of said cylinder toward said edge of said circular plate and occupying said annular opening, said flange having a tapered inner edge spaced about one-sixteenth inch from said outer edge of said plate, whereby to form an annular slit for passage of air or steam therethrough;

(e) a substantially toroidal body secured to said cylinder at said top end thereof, said toroidal body comprising an annular cover secured to said top end of said cylinder and projecting inwardly substantially normal to said side wall thereof, and an inner cylindrical wall depending from said annular cover and defining an interior cavity, said inner wall being coaxial with said side wall of said cylinder and aligned with said annular slit and terminating in a tapered lip projecting toward and spaced from said annular slit;

(f) a phasing plug of parabolic axial cross-section secured to said plate and projecting into said interior cavity of said toroidal body in coaxial relation therewith; and (g) an exponential horn attached to said toroidal body at the end thereof remote from the base end of said cylinder;

(h) said toroidal body and said side wall of said cylinder defining an annular sound chamber the working length of which is the distance between said annular flange and said annular cover, said working length determining the wavelength of sound generated by passage of air or steam under pressure through said annular slit and impinging against said tapered lip.

2. The whistle of claim 1, wherein the area of said inlet is at least equal to the area of said annular slit.

3. The whistle of claim 1, wherein the ratio of length to width of said sound chamber is about 3:1.

4. The whistle of claim 2, wherein the inner diameter of said inlet is about 3 inches.

5. The whistle of claim 4, wherein the length of said sound chamber is about 7.5 inches, and the width is about 2.5 inches, whereby to generate a sound frequency of about 418 hertz when operated with air at 15 psig, and an output of 135 decibels at 100 feet on axis.

6. The whistle of claim 1, wherein said inner edge of said annular flange has a taper of 30°.

7. The whistle of claim 1, wherein said lip on said inner cylindrical wall of said toroidal body has a taper of 15°.

8. The whistle of claim 1, wherein the frequency of sound produced in said sound chamber ranges from 200 to 1000 hertz.

9. The whistle of claim 1, wherein said horn has a resonant frequency substantially less than that of said sound chamber.

10. The whistle of claim 9, wherein the outermost diameter of said horn is about 1.5 times the wavelength of the generated sound.

11. The whistle of claim 1, wherein the maximum diameter of said phasing plug is about one-half the diameter of said inner wall of said toroidal body.

12. The whistle of claim 1, wherein the spacing of said tapered lip from said annular slit is less than one-half the working length of said sound chamber.

13. The whistle of claim 2, wherein the inner diameter of said inlet varies directly by the square root of the diameter of said base end.

14. The whistle of claim 1, wherein said toroidal body has a radiating mouth area which is equal to the cross-sectional area of said sound chamber.

* * * * *